US005611729A

United States Patent [19]

Schumacher et al.

[11] Patent Number: 5,611,729

[45] Date of Patent: Mar. 18, 1997

[54] SYSTEM FOR DISPLAYING THE OUTPUT OF A GAME OF CHANCE IN A DIFFERENT FORMAT

[75] Inventors: Paul M. Schumacher, Columbus, Nebr.; Robert D. Rizzi, Plantation, Fla.

[73] Assignee: Community Lottery Systems, Inc., Columbus, Nebr.

[21] Appl. No.: 370,983

[22] Filed: Jan. 10, 1995

Related U.S. Application Data

[63] Continuation of Ser. No. 147,317, Nov. 5, 1993, abandoned.

[51] Int. Cl.[6] ..... A63F 9/22

[52] U.S. Cl. ..... 463/18

[58] Field of Search ..... 463/18, 19, 30

[56] References Cited

U.S. PATENT DOCUMENTS 4,375,286 3/1983 Seitz et al. ..... 463/48 X
4,501,422 2/1985 Leshik ..... 463/7
4,871,171 10/1989 Rivero ..... 463/20
5,042,809 8/1991 Richardson ..... 463/18
5,088,737 2/1992 Frank et al. ..... 463/18
5,178,395 1/1993 Lovell ..... 463/19 X
5,188,363 2/1993 Marnell, II et al. ..... 463/13
5,192,076 3/1993 Komori ..... 463/18

*Primary Examiner*—William H. Grieb
*Attorney, Agent, or Firm*—Pollock, Vande Sande & Priddy

[57] ABSTRACT

The invention system substitutes the relatively unattractive output of a game of chance with a relatively exciting output of a different type of game of chance. For the exemplar Keno game, the output numbers of the Keno game are compared with numbers selected by a player. In the meantime, the output of the more exciting game is provided as a backdrop for the numbers selected by the player. After comparison, any common numbers to both the Keno game and the numbers selected by a player are displayed as symbols, for example in ways of three per a Slot game format, on a display monitor. Sound effects may also be added to provide additional excitement to the game.

21 Claims, 4 Drawing Sheets

PANEL B

Tkt # 1-3551 PANEL B GAME 27

A:27 44 67 B:18 35 58
C: 9 26 49 D:10 20 30
E: 1 21 41 F:36 37 38
G:71 73 75 H: 4 14 24
I:28 45 68 J:12 32 52
K: 7 16 25

11/3 PICKS AT $ .10

L:19 59 69 M:53 55 57
N: 2 3 13 O: 5 6 15
P: 8 17 29 Q:23 43 65
R:56 66 76 S:11 22 33
T:39 47 48 U:72 74 79

10/3 PICKS AT $ .15

V: 51 61 62 W:34 63 64
X:42 70 78 Y:31 40 80

4/3 PICKS AT $ .25

Z:46 50 54

1/3 PICK AT $ 1.40

BOOKED 1 GAME $ 5.00

Oct 8,1993 10:31:26 AM <1841>
We PAY on machine issued tickets.
Check Ticket before start of Game.

FIG. 3B

PANEL A

Tkt # 1-3550 PANEL A GAME 27

A: 3 61 67 B:29 42 80
C:25 30 65 D: 1 59 60
E: 9 45 76 F:50 54 75
G:17 63 74 H:34 39 51
I:15 46 56 J:31 35 69
K:12 46 56

11/3 PICKS AT $ .10

L: 6 37 40 M;10 32 44
N: 4 48 70 O:27 43 78
P:20 49 52 Q:36 41 79
R:26 53 57 S: 8 11 13
T: 2 23 58 U:21 28 62

10/3 PICKS AT $ .15

V: 7 22 38 W: 5 72 73
X:33 55 71 Y:14 19 68

4/3 PICKS AT $ .25

Z:18 66 77

1/3 PICK AT $ 1.40

BOOKED 1 GAME $ 5.00

Oct 8,1993 10:31:16 AM <1875>
We PAY on machine issued tickets.
Check Ticket before start of Game.

FIG. 3A

```
PANEL C
Tkt # 1-3552 PANEL C GAME 27
 A: 1 22 51     B: 6 27 56
 C:13 43 64     D: 9 30 59
 E:17 57 78     F:10 29 60
 G:15 36 65     H:18 39 68
 I:12 33 62     J:24 45 74
 K: 2 23 52
      11/3 PICKS AT $      .10
 L:25 44 75     M:16 35 55
 N: 7 26 47     O:11 32 61
 P:19 40 69     Q: 5 20 38
 R:14 54 73     S:50 70 79
 T: 8 28 49     U:37 48 77
      10/3 PICKS AT $      .15
 V:46 66 67     W: 3 34 53
 X:21 42 71     Y:31 41 72
      4/3 PICKS AT $       .25
 Z: 4 63 80
      1/3 PICK AT $       1.40
BOOKED  1 GAME    $       5.00

Oct 8,1993  10:31:41 AM  <1852>
We PAY on machine issued tickets.
Check Ticket before start of Game.
```

FIG. 3C

```
-----------------------------
GAME # 27 CLOSED
Oct 8, 1993 10:36:17 AM <1872>

SEQUENTIAL DRAW:
 67 71 25 74 59 49 36 1 47 70
 46 45 13 66 24 30 65 9 69 76

GAME # 27 RESULTS -- RANDOM DRAW

TICKET #  WINNINGS  ACCUM MULTI  GAMES
-----------------------------
 1-3550 - $   8.60
 1-3551 - $    .40
 1-3552 - $  19.00
-----------------------------
GAME SALES     = $     15.00
GAME WINNINGS  = $     28.00
SHIFT SALES    = $    285.00
SHIFT PAYOUT   = $       .00

NUMERICAL DRAW
  1  9 13 24 25 30 36 45 46 47
 49 59 65 66 67 69 70 71 74 76

Game Time 00h:06m

MULTIs Booked Forward =   0
-----------------------------
GAME # 28 OPEN
Oct 8,1993 10:37:10 AM
```

FIG. 4

SYSTEM FOR DISPLAYING THE OUTPUT OF A GAME OF CHANCE IN A DIFFERENT FORMAT

This application is a continuation of Ser. No. 08/147,317, filed on Nov. 5, 1993, abandoned.

FIELD OF THE INVENTION

The present invention relates to games of chance and particularly relates to a system for converting the output of a game of chance, such as Keno, to a format not ordinarily associated with that game.

BACKGROUND OF THE INVENTION

Many jurisdictions, as for example Nebraska, have legalized some of the more unattractive forms of games of chance such as Keno, scratch off cards and bingo. While Keno could be a lucrative game, it is nonetheless a reasonably unattractive game. As is well known, in a Keno game, a subset of numbers is randomly chosen from a larger predetermined set of numbers. For example, in the Nebraska Keno game, twenty numbers are randomly chosen from a universe of 80 numbers. To determine whether his ticket is a winner, the player compares the chosen numbers on his ticket with the twenty randomly chosen numbers which are then lit on an 80 number keno display board. The player's winnings depend on how many numbers, if any, he has chosen, the format in which they are chosen, and the number of those numbers that match the lit numbers on the display board. Clearly, such Keno game is not as exciting as other games such as for example One Arm Bandit or Slot machines.

Accordingly, to encourage more people to play what essentially is a dull game, a way of livening up the game is needed.

SUMMARY OF THE INVENTION

Albeit computer devices used to prim the tickets and select the numbers for a game such a Keno are strictly controlled and regulated in most states including for example Nebraska, the devices for displaying the game results are not. The inventors accordingly have come up with a system to transform the unattractive output of a game of chance such as Keno to a format resembling the output of a more exciting game such as for example a Slot game.

To achieve this end, the inventive system comprises a ticket terminal which allows a player to select from among a plurality of game templates the output of a particular game. The player can also enter a number of parameters that he desires. In addition, the player can either manually select the numbers that he wants or have the computer that controls the ticket terminal generate, by means of a random number generator, a set of number for playing the game.

The controller of the system, i.e. the system computer or processor which controls the operation of the ticket terminal, also has associated therewith a game random number generator for generating a subset of numbers from a predefined universe of numbers for a game such as Keno. The randomly chosen numbers are displayed in a conventional way, as for example on a 80 number Keno display board, and further compared with the set of numbers either selected by or generated for the player. The common numbers resulting from the comparison are provided to an integrator which integrates the game randomly generated numbers with the player selected numbers into the game output format previously chosen by the player. Thus, if the player had chosen to have the output of the Keno game to be displayed as the output of a Slot game, the template would be that of the Slot game. This template can be configured by the player to have a pay out ratio dependent on the different weights bet for the different numbers. For instance, in selecting the numbers, a player may bet that some chosen numbers are each worth 5¢, some worth 10¢, some worth 25¢ and some worth $1.40 etc. Thus, not only are the player selected numbers integrated to the player selected output template, the different numbers (either singly or in combination) of the template also would have different weights.

An exemplar embodiment of the invention system relates to a player having chosen to have the output of a Keno game to be displayed in a Slot game format. In this instance, since the output of the Slot game comprises groups (or ways) of three numbers, the player would select groups (ways) of three weighted numbers. These groups of three numbers, if the player wishes, would be generated by the random number generator associated with the ticket terminal, and compared with the numbers randomly generated for the Keno game (for example 20 numbers) by a comparator. And any group that has two or more Keno game numbers is considered a winner. The groups of numbers, in the meanwhile, are being converted from numbers to conventional slot machine symbols, for example cherries, lemons, gold bars and lucky 7's. These groups of symbols, as they fit within the slot game template, are displayed on a monitor in groups of three. To provide further excitement to the game, a multiple number of groups of three symbols representative of different tickets could be displayed on a monitor at any one time. The amount of winnings and the chances of winnings, etc. could also be displayed. So, too, any groups of three symbols that represent two or more Keno numbers are accentuated or highlighted on the monitor. Sound effects are also added to provide additional entertainment value. So that the interest of the players are maintained, not all of the winnings are displayed consecutively. To achieve this end, a variable ratio reinforcement generator is provided in the system to distribute the winning groups of numbers throughout the course of a particular game.

The respective components of the system are controlled by a controller computer. The monitors may be comprised of PC's (personal computer) connected by means of a network to the controller computer, which may also act as a server. The ticket terminal likewise may be connected to the controller computer/server. The random number generator may be a part of the controller computer or may be a conventional stand alone device. A database is further provided in the system to store the program for the controller computer as well as to provide the universe of numbers for the game of chance, the different symbols that may be displayed and the storage of statistics and data during the operation of the system.

It is therefore an objective of the present invention to provide an attractive game output for an otherwise unattractive game.

It is yet another objective of the present invention to enable a player to feel as if he is interacting with a game that conventionally does not require any interaction on his part other than to purchase the ticket.

BRIEF DESCRIPTION OF THE FIGURES

The above-mentioned objectives and advantages of the present invention will become more apparent and the invention itself will be best understood by reference to the following description of an embodiment of the invention taken in conjunction with the accompanying drawings, wherein:

FIGS. 3A–3C each represent a sample ticket purchased by a player; and

FIG. 4 is a receipt showing the result of an exemplar game.

DETAILED DESCRIPTION OF THE PRESENT INVENTION

Figure 1:
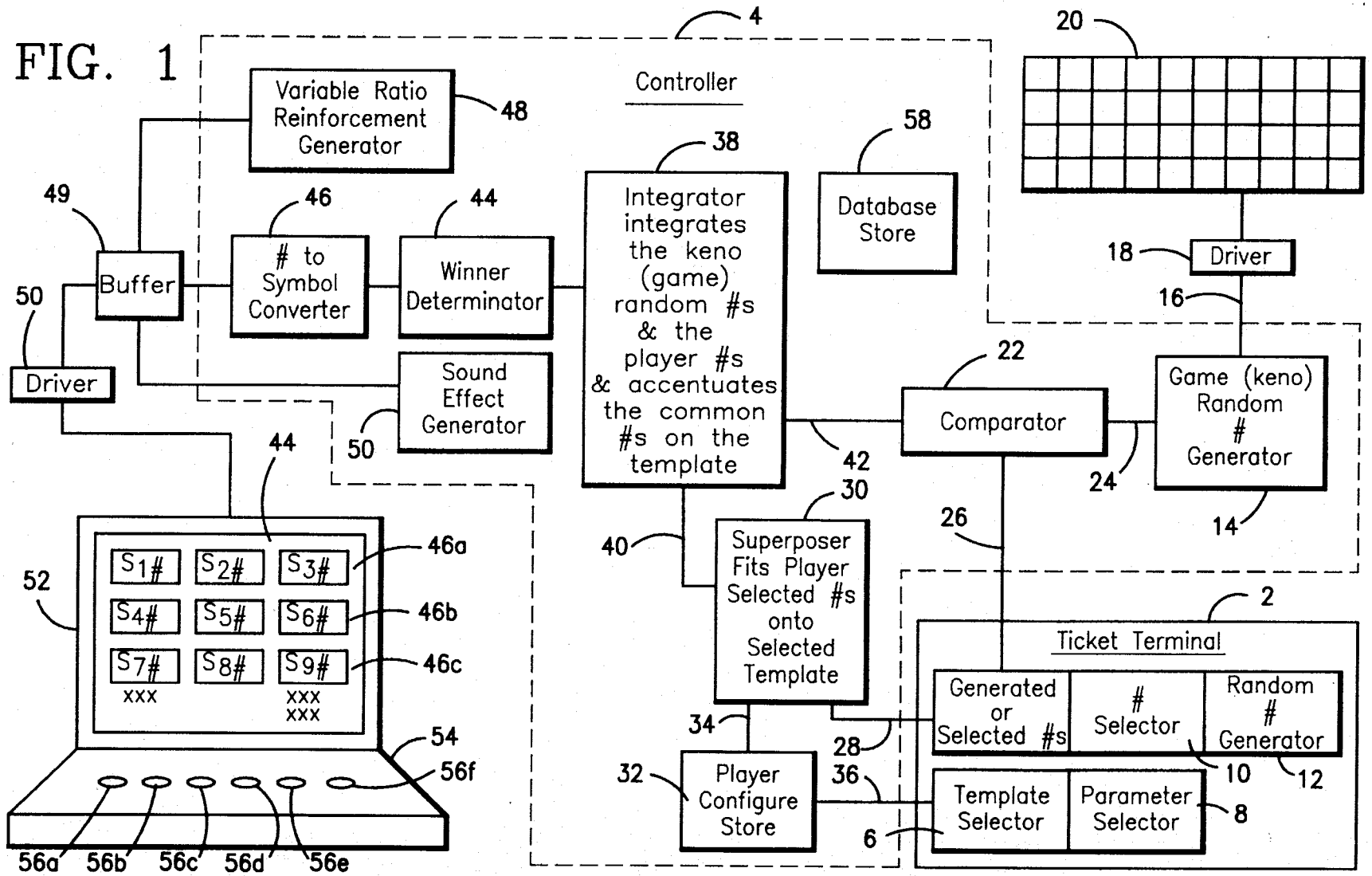
FIG. 1 is a block diagram of the different components of the present invention system.

With reference to FIG. 1, the system of the present invention is shown to comprise a ticket terminal 2 which is controlled by a controller computer 4. Ticket terminal 2 has a number of selectors such as for example a template selector 6, a parameter selector 8, a number selector 10 and a random generator 12. Ticket terminal, although not shown, does provide for issuance of tickets. As should readily be understood, number selector 10 is used by a player to select the numbers that he wants to play in a particular game of chance, as for example Keno. If the player does not want to manually enter the numbers but instead wants the numbers to be generated randomly, random number generator 12 is used. Template selector 6 is used by the player to select the specific type of game output that he desires, for example an output emulating a Slot game, One Arm Jack, Poker etc. The parameter selector 8 is used by the player to input configuration information that he desires the template of the game to have, for example the particular weights put on certain numbers that he has chosen. Once the player has provided input to the appropriate selectors (and of course paid), he is issued a ticket. The format of the ticket (or tickets) that a player is issued will be discussed later.

Further with respect to FIG. 1, controller 4, as encompassed within the dotted line, has a number of components which may or may not be integrated within the controller itself. For example, a well known game random number generator 14 may be an integral part of the computer or may be formed separately by discrete shift registers. Instead of being part of controller 4, game random generator 14 may be integrated to ticket terminal. Or for that matter, game random generator 14 may be replaced by some other means of generating random numbers, such as for example the conventional mechanism that randomly outputs numbered ping pong balls Connected to random number generator 14 by an output line 16 is a conventional driver 18, which lights the appropriate numbers output from random number generator 14 on display board 20. For the exemplar Keno game having a predetermined universe of 80 numbers, for example 1 to 80, display board 20 is divided into 80 corresponding display numbers, each lit in accordance with each number being randomly generated by random number generator 14.

Connected to random number generator 14 via line 24 is a comparator 22 which compares the output from random number generator 14 and the output provided from ticket terminal 2 via line 26. Comparator 22 may be an integral part of controller 4, or alternatively be resident in ticket terminal 2.

Further connected to accept a second output from ticket terminal 2 via line 28 is a superposer 30 which has a second input from a player configuration store 32 via lines 34. Player configuration store 32, as its name implies, stores the configuration parameters input by the player to ticket terminal 2 via line 36. For example, a player may select a certain chosen number to have a weight of a particular value, for example 25¢ or 10¢. Such configurations are provided by player configuration store 32 to superposer 30, which superposes the player configuration parameter input per parameter selector 8 and the particular template selected by the player per template selector 6. Instead of superposing the player selected numbers onto the selected template, superposer 30 can superpose onto the particular template the randomly selected number from random number generator 12 of ticket terminal 2.

The thus superposed template with the corresponding numbers is sent to an integrator 38 which may also be a part of the processor of controller 4, via line 40. Also provided as an input to integrator 38 via line 42 are the numbers which are common to both game random number generator 14 and ticket terminal 2. In other words, those numbers selected by the player at ticket terminal 2 which match the numbers generated by game random number generator 14 are considered common numbers. Integrator 38 integrates the game random numbers and the player numbers and flags the common numbers on the template.

For the game of Keno whose output is to be displayed in the form of a Slot game, the flagged numbers are important for determining whether a player has chosen a winner. To elaborate, the template provided for a slot game output divides the player selected (manually selected or randomly generated) numbers into a plurality of groups of three numbers each. Each of these groups of three numbers may be considered as a way pick, as it symbolizes a way to win. For the exemplar game for the instant invention, the player may select a ticket having 26 groups of three numbers. This ticket is denoted as a "panel". Thus, a "panel" is the same thing as a ticket. Further, a weighted group of three on a panel (ticket) is the same as a "way" on a panel (ticket). Accordingly, in the exemplar game, there are 26 ways to get a three. A more detailed discussion of the play tickets will follow.

The output of integrator 38 is provided as an input to a winner determinator 44 which determines from each group of three numbers whether at least two of those numbers selected by the player are also numbers randomly generated for that particular Keno game. And if it is determined that at least two of the group of three numbers are common numbers, then a further determination is made on whether all three of those numbers in the group are numbers generated by the game random number generator 14. Further, the amount of return in winnings is dependent on the weight placed by the player on the numbers of the group. For example, based on a pay out ratio of 42, if a player has placed a 10¢ bet on a group that has three common numbers, the winnings for that group would be $4.20. On the other hand, if the player has placed a bet of $1.40 for the group, that three common number group would return $58.80.

Having determined whether a group (or a way) is a winner, those numbers are provided to a number to symbol converter 46 which converts those numbers into particular symbols which, for the instant example of a Slot game, may be in the form of cherries, lemons, gold bars and lucky 7's. Further according to the weight or bet placed by the player, those numbers are represented by different symbols. For example, for a bet of 10¢, a number is represented by a cherry. Number to symbol converter 16 further converts a number having a weight of 15¢ to a lemon, a number having a bet of 25¢ to a gold bar, and a number having a bet of $1.40 to a lucky 7. Of course, it should be appreciated that different symbols could also be used, or that those symbols listed could in fact be allotted for different weights.

The thus converted symbols are next provided to a buffer 49, which is configured to be able to store a plurality of games, for example 6, so that a player does not have to monitor his game on a real time basis. The symbols from the buffer are then provided to a driver 50 to drive a monitor 52, which may be a part of a stand alone PC connected to controller 4 via a conventional network.

As shown, screen 44 of monitor 52 displays three horizontal groups each having three symbols. Each of those groups of three symbols may be referred to as one way of a 26 way panel in the exemplar game. Thus, each of panel 46*a*, panel 46*b* and panel 46*c* represents one of 26 ways to make three on a panel (ticket). And instead of three panels, the monitor may be configured to display a smaller or a greater number of panels. Further shown on screen 44 at the bottom thereof is display data representing the winnings, the game number and other miscellaneous information for the player.

Further with respect to screen 44, it should be appreciated that each of the symbols is represented by S. The number corresponding to each symbol is provided at the lower right-hand corner of the square within which the symbol resides. Thus, for screen 44 of FIG. 1, the "way" or group of three deployment on panel 46*a* could very well have a cherry symbol $S_1$, a lemon for symbol $S_2$ and a lucky 7 for symbol $S_3$. Needless to say, the "way" on panel 46*a* is a no winner. However, with respect to panel 46*b*, assume symbol $S_4$ is a cherry, symbol $S_5$ likewise a cherry and symbol $S_6$ a lemon. Panel 46*b* is therefore deemed to be winner in that the player gets his money back (assume a pay back ratio of 1 for 2 out of 3). Now further assume symbol $S_7$, $S_5$ and $S_9$ of panel 46*c* are all gold bars. This means that the player of panel 46*c* has a winner of gold bars which, having a weight of 25¢, would pay the player $10.50 (assume a pay back ratio of 42).

To make the output of the game more exciting, there is further included in controller 4 a variable ratio reinforcement generator 48 to provide spacing to the display of winners on screen 44 so that the possibility of consecutive winners being displayed is substantially reduced, if not eliminated. Reinforcement generator 48 has incorporated therein a variable ratio reinforcement schedule, which is based on principals of behavior so as to be designed to reduce boredom and increase response from the player. In essence, the system computer integrates the results of a game of chance with the principals of behavior to optimize play and pleasure from the game. Putting it differently, the spacing of winners to be displayed on screen 44 ensures that the player would stay alert and be more inclined to continue to play the game. Thus, the frequency and patterns with which the player views his winnings (rewards) is controlled to maximize the player's attention and enhance the pleasure that the player gets from playing the game.

To further enhance the enjoyment of the game, a sound effect generator 50 is also added to the system. What sound effect generator 50 does is to provide different simulated noises when the panels are being displayed on screen 44. In the case where monitor 52 is connected to a stand alone PC, sound effect generator 50 may be a sound board such as the Creative Labs Sound Blaster version 2.0 or Adlib compatible expander board inserted into one of the expander slots of the PC. Likewise, monitor 52 may be a conventional VGA or SVGA display driven by a 1 Mb VRAM video adapter. Stand alone PC is connected to controller processor/server 4 by means of Local Area Network (LAN) via a conventional network adapter card, for instance a conventional Ethernet or Token Ring adapter card fitted to the PC. Moreover, PC 54 may be a conventional microcomputer having a 80386DX or a 80486DX 33 MHz CPU or a Pentium-based motherboard. Of course, a sufficient amount of RAM for example 4 Mb is provided in PC 54. Although not shown, further built into PC 54 is a conventional hard disk to provide storage of well known programs.

Further with respect to PC 54, it can be seen that there are 6 buttons 56*a* to 56*f*, which may be incorporated into a conventional keyboard. For the embodiment shown in FIG. 1, key 56*a* is a menu button that provides a menu to the player to teach the player how to operate PC 54. Key 56*b* provides the player the option of viewing on screen 44 a traditional Keno display board such as 20, if the player desires to see the 20 randomly drawn numbers. See for example FIG. 4 where the numbers are shown under "Sequential Draw:" or "Numerical Draw:". Key 56*c* is a rule and information key that provides information to the player on the rules of the game. Key 56*d* is a change key that changes the display on screen 44 and/or the game to be viewed. Key 56*e* is an optional key that could be utilized for future usage, while key 56*f* is the play button for initiating the viewing of screen 44.

Controller 4 of the invention system may be comprised of a 80486 server that has sufficient RAM and a sufficient storage disk, represented by database store 58. The key board and the floppy drives for providing input information to controller 4 are not shown. Further not shown is a display for the technician who maintains the system. To connect PC 54 to controller 4, as was mentioned previously, a LAN connection provided by Ethernet adapters may be used. Alternatively, controller 4 may be hard-wired to PC 54. Likewise, ticket terminal 2 is connected to controller 4, via either LAN or hard-wired. Although only one PC is shown in FIG. 4, it should be appreciated that a plurality of stand alone PCs such as 54 are controlled by controller 4, so that a plurality of players can view different monitors.

Figure 2:
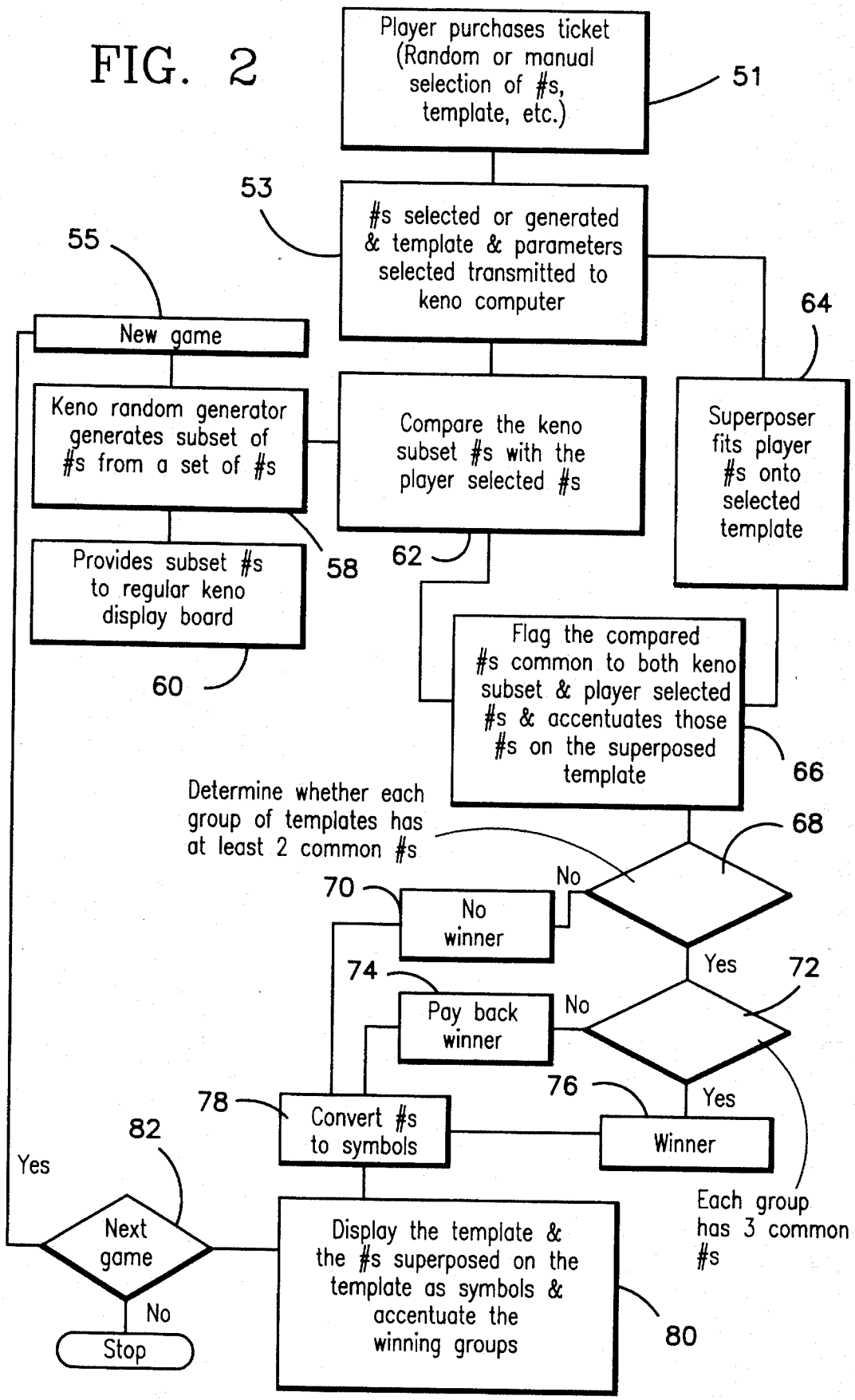
FIG. 2 is a simplified flow chart illustrating the operation of the instant inventive system.

The operation of the inventive system is described herein with reference to FIGS. 2 to 4. With reference to the flow chart on FIG. 2, a player purchases his ticket or tickets from ticket terminal 2 per block 51. As discussed, during the time of purchase, for the instant embodiment, a player may manually select the numbers he desires or have random number generator 12 randomly generate a plurality of numbers. Assume for the instant embodiment that the player wants to play a plurality of ways and does not want to manually input all of the numbers. The inventive system is equipped to provide a plurality of tickets such as for example tickets A, B and C shown in FIGS. 3A, 3B and 3C, respectively. The respective ways each of the tickets may be predefined are shown in FIGS. 3A to 3C. Alternatively, the numbers of the tickets may be randomly generated so that each ticket may have a different set of numbers for the different ways.

With specific reference to FIGS. 3A–3C, it can be seen that each of those tickets is divided into a plurality of ways or groups each having three numbers. Thus, for the A ticket of FIG. 3A, group A has numbers 3, 61 and 67. The same group A in the B ticket meanwhile has numbers 27, 44 and 67; while group A of the C ticket has numbers 1, 22 and 51. For the sake of convenience, each of the tickets is divided into 26 groups such that each ticket has a combined total of 78 numbers. It should be noted that the exemplar Keno game has a universe of 80 numbers. Further note that each of the tickets is divided into four sets of "picks" each having a different number of groups. For example, there are eleven groups (A–K) for the "11⅓" picks, 10 groups (L–U) for the "10⅔" picks, four groups (V–Y) for the "4⅔" picks and one group (Z) for the "1⅓" pick.

For the present invention embodiment as illustrated by the tickets of FIGS. 3A–3C, it is assumed that either controller 4 or the player has predefined the configuration of each ticket with the weights shown. Specifically, each of the "11⅓" picks has a weight of 10¢, the "10⅔" picks a weight of 15¢, the "4⅔" picks a weight of 25¢, and the "1⅓" pick a weight of $1.40. Thus, depending on which groups the numbers are chosen for, those numbers would have different weights for different tickets. For example, the number "18" is configured to group Z for the A ticket, group B for the B ticket and group H for the C ticket. Accordingly, the number "18" has a weight of $1.40 for the A ticket, and 10¢ for both B and C tickets. Of course, it should be appreciated that in order for group Z of the A ticket to come in as a winner, not only does "18", but also "66" and "77", need to be chosen by game random number generator 14.

As discussed above, the output of the exemplar Slot game displays a number of symbols such as cherries, lemons, gold bars and lucky 7's. For the tickets shown in FIGS. 3A–3C, these symbols have correspondence with the 26 groups as follows: Groups A–K are represented as cherries, groups L–U lemons, groups V–Y gold bars, and group Z lucky 7's. Thus, any of those numbers in each of groups A–K is represented by a cherry, those in groups L–U by a lemon, those in groups V–Y by a gold bar and those in group Z by a lucky 7. Thus going back to our earlier example, the number "18" for the A ticket would have a symbol of lucky 7, while the same number for the B and C tickets would each have a cherry symbol. This is assuming that each number of those groups matches the randomly generated number by game random generator 14 and is displayed as such on screen 44 of FIG. 1. In other words, with reference to group A of the A ticket, assume that number 3 was picked by random number generator 14 while numbers 61 and 67 were not, then group A of the A ticket, when displayed on screen 44 as panel 46*a*, will show a cherry symbol at $S_1$, but symbols other than a cherry at $S_2$ and $S_3$. Accordingly, group A of the A ticket would not be a winner. This process repeats for each of the groups A–Z for each of the tickets shown in FIGS. 3A–3C, as respective different panels 46*a*–46*c* of each of the FIGS. 3A–3C tickets are separately shown on screen 44. Furthermore, with variable ratio reinforcement generator 48 controlling the spacing of the winning groups, different ways for the different tickets may be shown at any one time. Putting it differently, at screen 44, panel 46*a* may for example be displaying group A of the FIG. 3A ticket, panel 46*b* group N of the FIG. 3B ticket, and panel 46*c* group W of the FIG. 3C ticket.

Continue with the flow diagram of FIG. 2. Block 53 discloses that the number selected by the player or generated in ticket terminal 2, as well as the template and parameters selected by the player, are transmitted to controller computer 4. Independent of ticket terminal 2 and whether a player is selecting numbers from ticket terminal 2, a new game is started per block 55. It should be appreciated that for the exemplar Keno game, the system could be configured to have a new game started approximately every 5 minutes. Upon start of the game, game random number generator 14 generates a subset of numbers from the universe of predetermined numbers, for example the 80 numbers from 1–80, in block 58. Thereafter, the randomly generated numbers, as a subset of the predetermined set of 80 numbers, are displayed on a conventional display, as for example display board 20 by having each of the randomly generated numbers lit up per block 60. At the same time, the randomly generated numbers are provided to block 62 where the numbers selected by the player (or randomly generated at ticket terminal 2) are compared with the game numbers randomly generated by random number generator 14.

While the subset of randomly generated numbers from the game random number generator are compared with the numbers selected by the player, superposer 30 of the system fits the player selected numbers onto the player selected template, as for example a slot game template in block 64. In the next block 66, any common numbers between the subset of randomly generated numbers and the player selected numbers are flagged and accentuated or highlighted on the superposed template. It is at this stage that the weights picked by the player such as the amount of money that the player bets on each of his selected (or generated) numbers are noted. Furthermore, it is at this stage or in block 64 that the groups of selected numbers are determined to fall within certain groups (or ways) selected by the player, provided that the player were to play all 26 ways per the tickets shown in FIGS. 3A–3C.

In decision block 68, a determination is made on whether each group of three numbers selected by the player, now noted on the player's selected template, has at least two common numbers from game random number generator 14. If not, the system determines that there is no winner for that way per block 70. If yes, then the system proceeds to the next decision block 72 to determine whether that group has three common numbers. If not, system processor will note that that group is a payback winner insofar as the player would get back whatever he paid when he picked that way, per block 74. If the system processor determines indeed that all three numbers within the group are randomly chosen numbers by game random number generator 14, then a winner is determined per block 76. The payment for a winner is of course dependent on the ratio established in a predetermined pay table which, for the instant exemplar game, is assumed to be 42 times of what the player has bet on that group.

In any event, notwithstanding whether there is no winner, a payback winner or a winner, the system next proceeds to block 78 whereby the numbers are converted to corresponding symbols such as for example the cherries, lemons, gold bars and lucky 7's mentioned above. Thereafter, the symbols are displayed in the format of the template selected by the player on screen 44 per block 80. As those symbols are being displayed in groups of three, winners are accentuated or highlighted. And as discussed above, screen 44, for the instant example embodiment, displays three different panels 46*a*–46*c* each representing one of the groups of one of the tickets of FIGS. 3A–3C. After reviewing a "way" from panels A, B and C, the player can either push the play button 56*f* (FIG. 1) to view the next "way" from each panel or wait a predetermined amount of time, for example 4 seconds, and the system processor will automatically display the next "way" from each panel. Thus, all of the groups, for example all 26 groups, of the tickets are displayed on screen 44. Thereafter, a determination is made on whether there is a next game per decision block 82. If there is none, the system stops and the game is over. Otherwise, the system returns to block 56 to begin yet another game. The new game would of course encompass any action taken by any player at ticket terminal 2 subsequent to the previous game. Do note that the previous games, for example up to 6 as discussed previously, may also now be played from buffer 49.

Inasmuch as the present invention is subject to many variations, modifications, and changes in detail, it is intended that all matter described throughout this specification and shown in the accompanying drawings be interpreted as illustrative only and not in a limiting sense. For example, instead of choosing an output template for a Slot game, output templates for some other games such as Bingo or Poker can be selected by the player to provide the output format for the Keno game. The weights or bets to be placed on these other games would of course be different from that of the exemplar Slot game discussed above. Yet the same teachings would apply. For example, in a five card poker game, each group or way picked by the player consists of five numbers, instead of the three per the aforenoted Slot game. A ticket for such five card game should therefore contain 16 ways of winning, with the payback ratio for those 16 ways being configured by the winner or predefined by the system and made known to the player. Accordingly, it is intended that the instant invention be limited only by the spirit and scope of the appended claims.

Attached hereto and incorporated herein to this specification as an appendix is the program code of the instant invention system.

We claim:

1. System for displaying the output generated from a game of chance comprising:

terminal means to provide a player the option to choose from among a plurality of display formats a particular format to display said output of said game;

computing means for integrating said output from said game to said particular format as an integrated formatted output; and means for displaying said integrated formatted output as an integrated formatted display which is different from the output usually associated with said game.

2. System of claim 1, wherein said game comprises comparing selected numbers against predetermined numbers, said system further comprising:

means for randomly generating a subset of numbers as said output from a set of predetermined numbers.

3. System of claim 2, wherein said terminal means comprises:

input means for said player to at least select the numbers he wants to play and match with said subset of numbers generated by said generator means.

4. System of claim 3, further comprising:

means for comparing said numbers selected by said player with said subset of randomly generated numbers and flagging numbers common to both said generated subset of numbers and numbers selected by said player;

wherein said display means comprises rows; and wherein said display means displays any row in said integrated formatted display having at least two of said common numbers as an accentuated output.

5. System of claim 4, further comprising:

means for converting said subset of randomly generated numbers and said numbers selected by said player to symbols in accordance with said particular format; and wherein said display means displays said subset numbers and said numbers selected by said player as symbols in said integrated formatted display; and wherein any said accentuated output row represents a winner to said player.

6. System of claim 5, further comprising:

means working cooperatively with said display means to vary in time the display of said numbers determined to be common to both said subset of numbers and said numbers selected by said player to substantially eliminate the display of consecutive accentuated rows if there is more than one accentuated output row.

7. System of claim 2, wherein said terminal means further comprises:

means to generate a predefined set of numbers from said set of predetermined numbers with said particular format selected by said player.

8. System of claim 7, further comprising:

means for comparing said predefined set of numbers with said subset of randomly generated numbers and flagging numbers common to both said subset and said predefined set of numbers from said terminal means;

means for converting said subset of randomly generated numbers and said predefined set of numbers to symbols in accordance with said selected particular format;

wherein said display means displays said subset of numbers and said predefined set of numbers as rows of symbols within said particular format; and wherein any row having at least two of said flagged common numbers is highlighted to indicate a winner.

9. System of claim 8, further comprising:

means working cooperatively with said display means for providing sound effects as said symbols are being displayed.

10. System of claim 2, wherein said terminal means further comprises:

means for generating a random set of numbers from said terminal means for each particular format selected by said player.

11. System for converting the output generated from a game of chance to a display format different from that usually associated with said game, comprising:

terminal means to provide a player the option to choose from a number of display formats a particular format, said terminal means further including means for generating a random set of numbers for each particular format selected by said player;

computing means for integrating said output from said game to said particular format as an integrated formatted output; and means for displaying said integrated formatted output as an integrated formatted display;

means for randomly generating a subset of numbers as said output from a set of predetermined numbers;

means for comparing said numbers randomly generated from said terminal means with said subset of randomly generated numbers and flagging numbers common to both said subset and said set of numbers from said terminal means;

means for converting said subset of randomly generated numbers and said set of numbers from said terminal means to symbols in accordance with said selected particular format;

wherein said display means displays said subset of numbers and said set of numbers from said terminal means as rows of symbols within said particular format; and wherein any of said rows having at least two of said flagged common numbers is highlighted to indicate a winner.

12. System of claim 11, further comprising:

means working cooperatively with said display means to vary in time the display of said numbers determined to be common to both said subset of numbers and said set of numbers from said terminal means to reduce the possibility of displaying two successive rows having at least two of said common numbers.

13. System of claim 12, further comprising:

means working cooperatively with said display means for providing sound effects as said symbols are being displayed.

14. System for displaying the output of a Keno game in a Slot game format, comprising:

ticket terminal to enable a player to purchase at least one of a plurality of tickets each having a predefined set of numbers;

random number generator for generating a subset of numbers from a predetermined set of numbers, said predetermined set of numbers substantially corresponding to said predefined set of numbers;

means for integrating said predefined set of numbers to a Slot template corresponding to said ticket purchased by said player in which said predefined set of numbers are divided into multiple rows each having three of said predefined numbers;

means for comparing the predefined set of numbers relating to the ticket purchased by said player with said subset of numbers to determine common numbers to both said predefined set of numbers and said subset of numbers;

means for converting said predefined set of numbers to symbols in accordance with said template; and monitor means for displaying said rows of symbols.

15. System of claim 14, further comprising:

means working cooperatively with said monitor means for providing sound effects when said monitor means displays said rows of symbols.

16. System of claim 14, wherein said monitor means displays three of said rows of symbols during each of a plurality of display periods until all of said rows are displayed, said system further comprising:

means for varying the display of highlighted rows during different ones of said display periods to reduce the possibility that consecutive highlighted rows are displayed during the same display period.

17. System of claim 14, further comprising:

means for flagging any of said rows having at least two of said common numbers;

wherein said flagged rows are displayed as highlighted rows by said monitor means.

18. System of claim 14, wherein said highlighted rows are representative of winners.

19. System of claim 17, wherein each of said rows of three symbols are assigned different weights so that different amounts of winnings are paid out for different highlighted rows.

20. System of claim 16, wherein said means for varying integrates the results of said game with principals of behavior to optimize the attention of said player to said game and enhance the pleasure said player gets from playing said game.

21. System for displaying the output of a game of chance, comprising:

means having a plurality of formats each adaptable for displaying the output of said game of chance;

input means for providing a player the option of selecting from among said plurality of formats a particular format to display the output of said game;

means for fitting the output of said game to said particular format selected by said player as an integrated output; and means for displaying said integrated output as an output usually associated with another game of chance.

* * * * *